US010354477B2

(12) United States Patent
Magno et al.

(10) Patent No.: US 10,354,477 B2
(45) Date of Patent: Jul. 16, 2019

(54) BEVERAGE VENDING MACHINE

(71) Applicant: N&W GLOBAL VENDING S.P.A., Valbrembo (IT)

(72) Inventors: Alessandro Magno, Brembate Sopra (IT); Alberto Crippa, Valbrembo (IT); Mauro Scotti, Bergamo (IT)

(73) Assignee: N&W GLOBAL VENDING S.P.A., Valbrembo (IT)

( * ) Notice: Subject to any disclaimer, the term of this patent is extended or adjusted under 35 U.S.C. 154(b) by 65 days.

(21) Appl. No.: 15/568,870

(22) PCT Filed: May 2, 2016

(86) PCT No.: PCT/IB2016/052480
§ 371 (c)(1),
(2) Date: Oct. 24, 2017

(87) PCT Pub. No.: WO2016/174647
PCT Pub. Date: Nov. 3, 2016

(65) Prior Publication Data

US 2018/0102016 A1 Apr. 12, 2018

(30) Foreign Application Priority Data

Apr. 30, 2015 (EP) ..... 15166091

(51) Int. Cl.
*G07F 13/06* (2006.01)
*G07F 13/10* (2006.01)

(52) U.S. Cl.
CPC ..... *G07F 13/065* (2013.01); *G07F 13/10* (2013.01)

(58) Field of Classification Search
CPC ..... G07F 13/065; G07F 13/07
USPC ..... 141/174, 272, 372
See application file for complete search history.

(56) References Cited

U.S. PATENT DOCUMENTS 2,598,665 A * 6/1952 Levings ..... G07F 13/10 141/372
3,460,593 A * 8/1969 Kuckens ..... A47F 1/106 141/174
3,759,303 A * 9/1973 Henrichs ..... B65B 43/44 141/1

(Continued)

FOREIGN PATENT DOCUMENTS

EP 2565853 3/2013

OTHER PUBLICATIONS

International Search Report and Written Opinion from International Application No. PCT/IB2016/052480 dated Jul. 28, 2016.

*Primary Examiner* — Timothy L Maust
(74) *Attorney, Agent, or Firm* — Dorsey & Whitney LLP

(57) ABSTRACT

A beverage vending machine (1) comprising a cup storage (3), a cup support device (9) in a cup filling station (7), and a stirrer dispenser (6) to feed a stirrer (6*a*) to a cup (4) in the cup support device (9). The cup support device (9) is defined by a body in the form of an open ring (11) with a vertical axis (12), a cup supporting surface (15), and a lateral opening (13) to allow the cup to be transversally extracted from the open ring body (11). The supporting surface (15) has at least one projecting area (19) configured to cause the planarity of the cup supporting surface (15) imperfect so as to cause the cup (4) to tilt, with respect to the cup support device (9), in response to the supply of a stirrer (6*a*) to the cup (4).

15 Claims, 3 Drawing Sheets

(56) References Cited

U.S. PATENT DOCUMENTS

| | | | | | |
|---|---|---|---|---|---|
| 5,261,467 | A * | 11/1993 | Yamamoto | G07F 13/10 | 141/129 |
| 6,053,359 | A * | 4/2000 | Goulet | B67D 1/00 | 221/221 |
| 6,073,667 | A * | 6/2000 | Graffin | B67C 3/202 | 141/372 |
| 8,839,987 | B2 * | 9/2014 | Doglioni Majer | G07F 13/10 | 141/168 |

* cited by examiner

FIG. 2
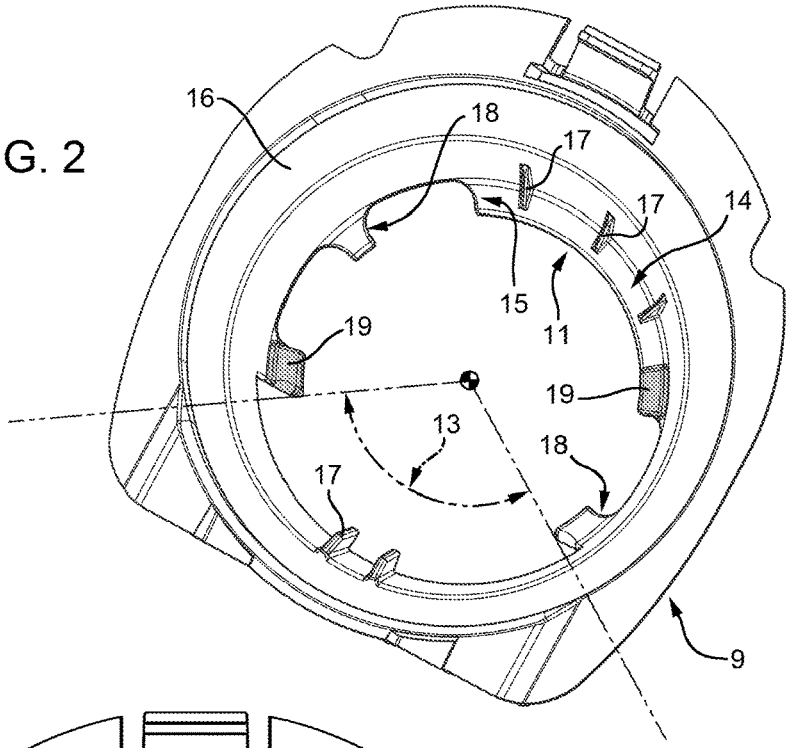
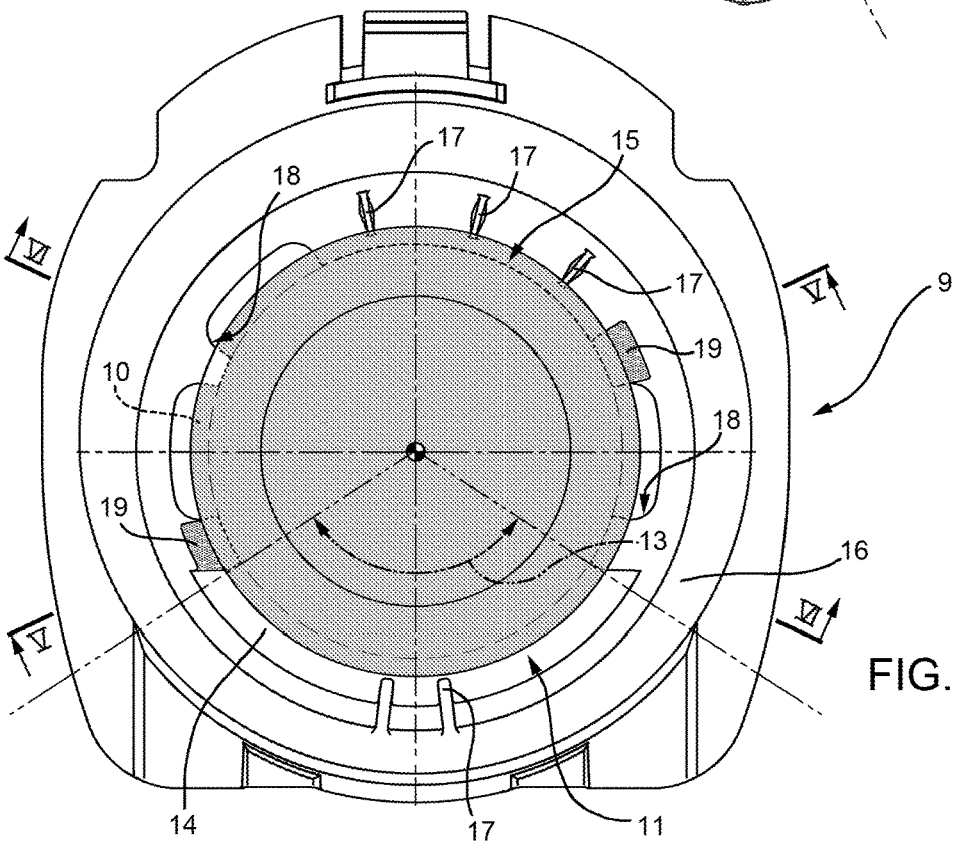
FIG. 4

BEVERAGE VENDING MACHINE

TECHNICAL FIELD OF THE INVENTION

The present invention concerns a beverage vending machine, for example coffee, tea, cappuccino or similar.

STATE OF THE ART

In general, a beverage vending machine of known type comprises of a cup storage for a plurality of stacks of nested cups, and a cup feed device, which is adapted to remove a single cup from the cup storage in response to the selection of a beverage by a user and feed it to a filling station, in which the cup receives the ingredients that compose the beverage by means of a delivery nozzle assembly defining the outlet of a beverage production unit arranged inside the vending machine.

To support the cup in the filling station during preparation of the beverage, the vending machine normally comprises of a support device which normally is in the form of an open ring configured to receive from above a cup previously removed from the cup storage by the feed device and to allow a user, when the beverage is ready, to manually remove the cup, sliding it transversally out of said support device.

Furthermore, according to a type of vending machine, the support device can be a fixed element arranged in the area of the filling station which, in this case, is obtained in a withdrawal compartment accessible from the outside by the user. Alternatively, according to a different type, the support device can be a movable element configured to move between a cup receiving station and the withdrawal compartment, passing through the filling station if the latter is not inside said withdrawal compartment.

In general, a vending machine of known type comprises, in addition to the beverage production unit, also a sugar dispenser and a stirrer dispenser, the stirrer being usually introduced into the cup before the ingredients that compose the beverage.

The Applicant has observed that when the stirrer falls into the empty cup suspended on the support device, it tends to bounce off the bottom of the cup and, in some cases, this bounce can be of such entity as to cause the stirrer to jump out of the cup.

SUBJECT AND SUMMARY OF THE INVENTION

The object of the invention is to provide a beverage vending machine which simply and inexpensively overcomes the drawback described above.

According to the present invention a beverage vending machine is provided according to the attached claims.

BRIEF DESCRIPTION OF THE DRAWINGS

The invention will now be described with reference to the attached figures, which illustrate a non-limiting embodiment thereof, in which:

FIG. 2 illustrates, in a perspective view and with parts removed for clarity, a cup support device forming part of the beverage vending machine of FIG. 1.

FIG. 4 is a plan view of the support device of FIG. 2.

DETAILED DISCLOSURE OF PREFERRED EMBODIMENTS OF THE INVENTION

The present invention will now be described in detail with reference to the attached figures to allow a person skilled in the art to produce it and use it. Various modifications to the embodiments described will be immediately evident to persons skilled in the art and the generic principles described can be applied to other embodiments and applications without departing from the protective scope of the present invention, as defined in the attached claims. Therefore, the present invention must not be considered limited to the embodiments described and illustrated, but given the widest protective scope in accordance with the characteristics described and claimed.

Figure 1:
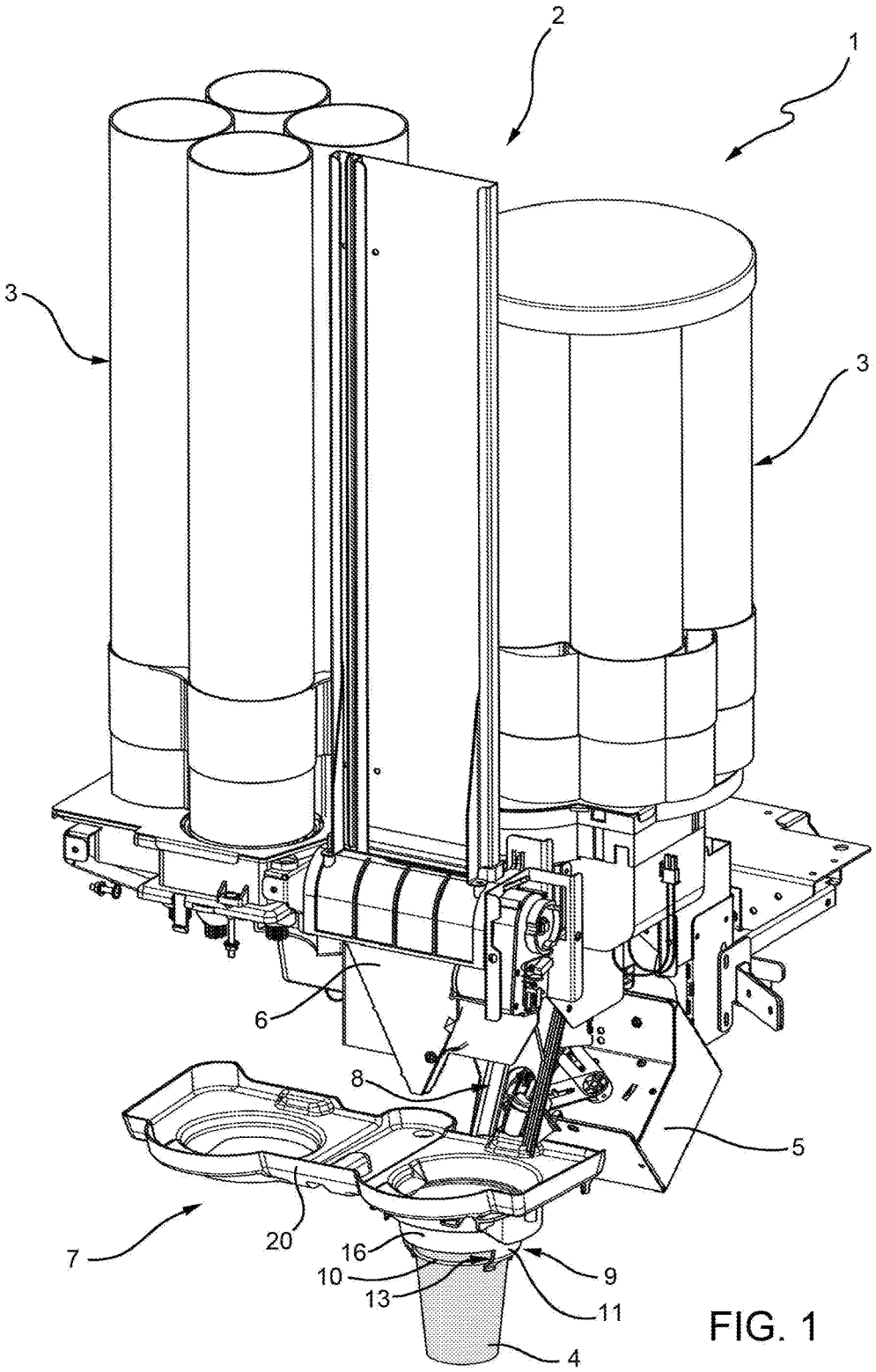
FIG. 1 illustrates, with parts removed for clarity, a preferred embodiment of the beverage vending machine of the invention.
Figure 6:
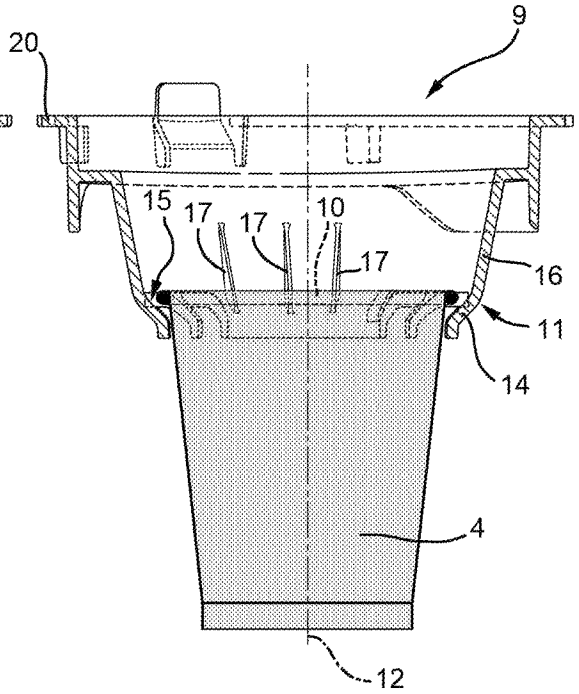
FIGS. 5 and 6 illustrate two sections of FIG. 4, according to the lines V-V and VI-VI respectively.
Figure 5:
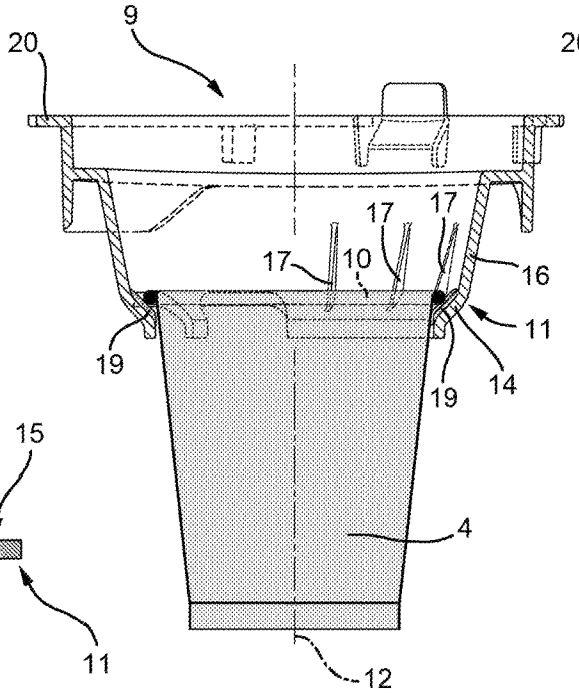

In FIG. 1, the number 1 indicates as a whole a beverage vending machine comprising of a cup distribution unit 2 provided with one or more storages 3. In the example illustrated, the container unit 2 comprises two tower storages (of known type and, for this reason, not described in detail), each of which is adapted to contain a respective plurality of piles of cups 4 with size the same as or different from the cups of the other storage 3.

The beverage vending machine 1 further comprises a sugar dispenser 5 and a stirrer dispenser 6 (both of known type) adapted to feed, if required by the beverage selected by the user, a dose of sugar and/or a stirrer 6*a* into the cup 4 before the latter is filled.

The beverage vending machine 1 further comprises a feed assembly for feeding the cups comprising, for each storage 3, a respective release mechanism (of known type and not illustrated), which is adapted to withdraw from the storage a single cup in response to a selection of a beverage by a user, and a respective transfer member adapted to convey the cup withdrawn by the release mechanism to a filling station 7; here the sugar and the stirrer 6*a* are introduced, if required, by means of the sugar dispenser 5 and the stirrer dispenser 6, and the ingredients that compose the beverage are introduced by means of a delivery nozzle assembly defining the outlet of a beverage production unit (of known type and not illustrated) arranged inside the vending machine.

In the example illustrated, the above-mentioned transfer member is defined by a fixed chute 8. According to a variation not illustrated, it can consist of a movable member adapted to receive the cup 4 from the release mechanism to transfer it to the filling station 7.

Lastly, the vending machine comprises a support device 9 for the cup, the function of which is to receive the empty cup 4 from the transfer member, in this case from the fixed chute 8, in order to support it in the filling station 7 below the outlets of the stirrer dispenser 6, the sugar dispenser 5 and the delivery nozzles for delivering the beverage ingredients.

The support device 9 is further shaped so as to allow a user, at the end of preparation of the beverage, to manually remove the full cup by sliding it transversally out of the support device 9.

Figure 3:
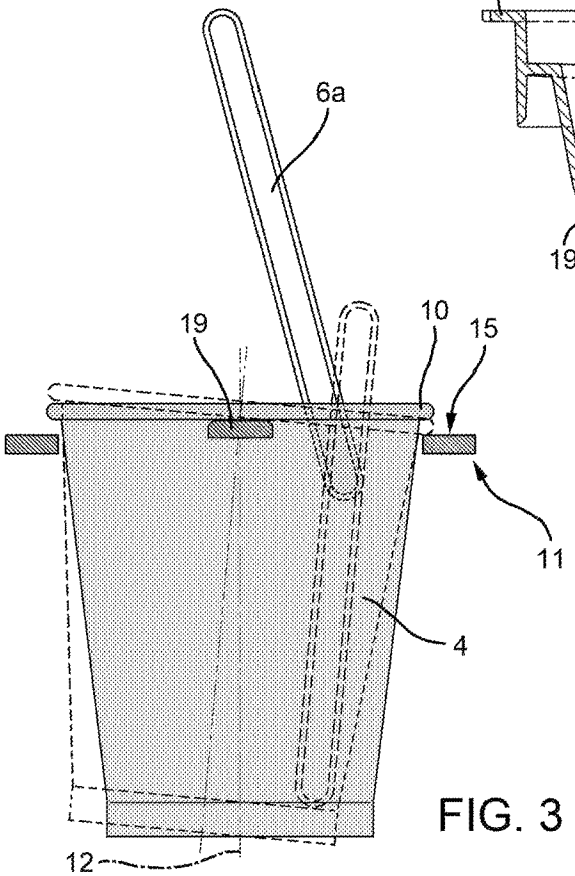
FIG. 3 illustrates, schematically, the support device of FIG. 2 during the introduction of a stirrer into the cup.

According to the illustration of FIG. 3, the type of cup 4 normally used in beverage vending machines is defined by a cup-shaped body made of plastic or paper, having a frustoconical lateral wall which is closed, at its smaller end, by a flat bottom wall and is provided, at its larger end, with an upper edge 10 extending towards the outside.

According to the illustrations of FIGS. 1, 2, 4 and 5, the support device 9 comprises an open ring 11, which is coaxial with a vertical axis 12, has a diameter smaller than the diameter of the edge 10, and has a lateral opening 13 of sufficient angular amplitude to allow a user to slide the cup 4 out in a transverse direction to the axis 12 and remove it from the support device 9. Preferably, the angular amplitude is approximately 120°.

The open ring 11 has a lateral wall 14, which is shaped so as to define, on the inner side facing towards the axis 12, a supporting surface 15 adapted to be engaged, in use, by the edge 10 of the cup 4 to sustain it when it is fed from above into the open ring 11.

The supporting surface 15 can be a coplanar surface perpendicular to the axis 12 or, according to the preferred embodiment illustrated in the attached figures, can be obtained on a portion of the lateral wall 14 having a generically frustoconical shape coaxial to the axis 12 and tapered towards the axis 12. In this case, therefore, the supporting surface 15 is a frustoconical surface, which has the advantage, with respect to a flat supporting surface perpendicular to the axis 12, of facilitating the centering of the cup 4 as it drops through the open ring 11.

Preferably, furthermore, in order to guide the substantially vertical drop of the cup 4 into the support device 9, the latter comprises a funnel-shaped tubular body 16, which is connected to the upper end of the open ring 11 and is coaxial to the axis 12. Preferably, the open ring 11 and the funnel-shaped tubular body 16 are obtained from one single plastic piece obtained by means of a hot moulding process. The vertical guide action of the funnel-shaped tubular body 16 is further accentuated by a plurality of radial ribs 17 connected to the inner surface of said tubular body 16.

The supporting surface 15 can extend continuously around the axis 12, excluding the sector corresponding to the angular opening 13 or, preferably, as in the example illustrated, is interrupted by recesses 18, the shape and arrangement of which allows any residual liquids to drop down and not form scale on the support device 9.

According to FIGS. 2 to 6, the supporting surface 15 has at least one area in relief 19 having the function of making the planarity of the supporting part of the cup 4 resting on the supporting surface 15 imperfect and leaving the cup 4 free to move, with respect to the support device 9, when stressed by a stirrer 6*a* falling into it.

In other words, the function of the area in relief 19 is to make the supporting part of the cup 4 unstable in order to transfer, to the latter, part of the quantity of motion of the stirrer 6*a* which hits the bottom of the empty cup 4 after being released by the relative dispenser device. In fact, by allowing the cup 4 to rock in its supporting seat, the cup 4 is able to absorb part of the impact of the stirrer 6*a* on the bottom of the cup which, otherwise, being relatively elastic with respect to the stick, could cause said stick to bounce and in some cases even project it outside the cup 4.

The area in relief 19 can be defined by a relief element on the supporting surface 15 or by a thickening of said supporting surface 15. According to the preferred embodiment illustrated in the attached figures, two areas in relief 19 are present defined by respective thickenings or reliefs, which are arranged on the supporting surface 15 in diametrically opposite positions and, when engaged by the edge 10 of the empty cup 4, slightly raise the supporting part of the cup 4.

When a stirrer 6*a* is released into the cup 4 (FIG. 3), the latter is free to rock around the diameter joining the two areas in relief 19, resting, during this oscillation, on the remaining supporting surface 15, which therefore limits the angular range of the cup 4 to a few degrees in one direction and in the other.

In order to maximise the damping effect obtained from the oscillation of the cup 4 made possible by the imperfect planarity of its supporting part, the areas in relief 19 are provided on the supporting surface 15 of the open ring 11 in given positions which take account of the direction in which the stirrer 6*a* drops into the cup 4 so that the application point of the force exerted by the stirrer 6*a* on the bottom wall of the cup is as far as possible from the projection, on the bottom of the cup, of the line joining the areas in relief 19 and, consequently, the rocking torque exerted on the cup is greater.

According to FIG. 1, if, as in the example illustrated, the beverage vending machine 1 is equipped with two storages 3, two support devices 9 are preferably provided, each of which is adapted to receive the cups 4 from the respective storage 4 associated with it.

Preferably, in this case, the two support devices 9 are carried by a common plate 20 which also acts as a drip tray.

Lastly, it should be pointed out that in the example illustrated, the filling station 7 is inside a withdrawal compartment and, in this case, the plate 20 with the support devices 9 occupies a fixed position in the withdrawal compartment. According to a variation not illustrated, the filling station 7 is not in the withdrawal compartment but in an inner area of the beverage vending machine 1 not accessible from the outside. In this case, the plate 20 or, in the absence of the plate 20, the single support devices are movable elements which move, in use, between the filling station, where the empty cup receives the stick, the sugar and the beverage ingredients, and the withdrawal compartment.

The invention claimed is:

1. A beverage vending machine, comprising:

a cup storage;

a cup support device to receive a cup from the cup storage; and a stirrer dispenser to feed a stirrer to the cup in the cup support device;

wherein the cup support device includes:

an open ring body that has a vertical axis;

a supporting surface to be engaged by an outwardly projecting cup rim to support the cup in the open ring body; and a lateral opening with a width such that the cup may be transversally taken out of the open ring body through the lateral opening;

wherein the supporting surface is shaped to cause the cup to be unstably suspended on the supporting surface so as to let the cup free to tilt, with respect to the cup support device, in response to supply of the stirrer to the cup.

2. The beverage vending machine according to claim 1, wherein the supporting surface includes two projecting areas.

3. The beverage vending machine according to claim 2, wherein the two projecting areas are arranged in diametrically opposite positions with respect to the vertical axis.

4. The beverage vending machine according to claim 2, wherein the two projecting areas are defined by respective embossed portions of the supporting surface.

5. The beverage vending machine according to claim 2, wherein the cup support device and the stirrer dispenser are relatively arranged so that, when the stirrer is supplied to the cup, a point of impact of the stirrer on a bottom of the cup defines a tilting arm with respect to a projection of an imaginary line joining the two projecting areas on the bottom of the cup, so as to impart to the cup a moment sufficient to cause the cup to tilt.

6. The beverage vending machine according to claim 1, wherein the supporting surface is generically frustoconical, coaxial to the vertical axis, and downwardly tapered.

7. The beverage vending machine according to claim 1, wherein the cup support device includes a guiding tubular body to guide the cup coaxial to the vertical axis and connected to an upper end of the open ring body.

8. The beverage vending machine according to claim 7, wherein the guiding tubular body and the open ring body are made in one single piece.

9. A cup support device for a beverage vending machine, the beverage vending machine including a cup storage to feed a cup to the cup support device, and a stirrer dispenser to feed a stirrer to a cup in the cup support device; the cup support device comprising:

an open ring body that has a vertical axis;

a supporting surface to be engaged by an outwardly projecting cup rim to support the cup in the open ring body; and a lateral opening with a width such that the cup may be transversally taken out of the open ring body through the lateral opening;

wherein the supporting surface is shaped to cause the cup to be unstably suspended on the supporting surface so as to let the cup free to tilt, with respect to the cup support device, in response to supply of the stirrer to the cup.

10. The cup support device according to claim 9, wherein the supporting surface includes two projecting areas.

11. The cup support device according to claim 10, wherein the two projecting areas are arranged in diametrically opposite positions with respect to the vertical axis.

12. The cup support device according to claim 10, wherein the two projecting areas are defined by embossed portions of the supporting surface.

13. The cup support device according to claim 10, wherein the cup support device and the stirrer dispenser are relatively arranged so that, when the stirrer is supplied to the cup, a point of impact of the stirrer on a bottom of the cup defines a tilting arm with respect to a projection of an imaginary line joining the two projecting areas on the bottom of the cup, so as to impart to the cup a moment sufficient to cause the cup to tilt.

14. The cup support device according to claim 9, wherein the supporting surface is generically frustoconical, coaxial to the vertical axis, and downwardly tapered.

15. The cup support device according to claim 9, wherein the support device includes a guiding tubular body to guide the cup coaxial to the vertical axis and connected to an upper end of the open ring body.

* * * * *